United States Patent [19]

Kessler et al.

[11] 4,400,415

[45] Aug. 23, 1983

[54] PROCESS FOR NICKEL PLATING ALUMINUM AND ALUMINUM ALLOYS

[75] Inventors: Richard B. Kessler, Jericho; Fred I. Nobel, Sands Point, both of N.Y.

[73] Assignee: Lea Ronal, Inc., Freeport, N.Y.

[21] Appl. No.: 292,580

[22] Filed: Aug. 13, 1981

[51] Int. Cl.[3] ..... C23C 3/02

[52] U.S. Cl. ..... 427/305; 204/33; 204/38 B; 427/328; 427/438

[58] Field of Search ..... 427/305, 328; 204/33, 204/38 B; 106/1.27

[56] References Cited

U.S. PATENT DOCUMENTS

| | | | |
|---|---|---|---|
| 2,958,610 | 11/1960 | Ramirez | 204/33 |
| 3,338,726 | 8/1967 | Berzins | 427/438 |
| 3,666,529 | 5/1972 | Wright | 427/438 |
| 4,125,648 | 11/1978 | Vratny | 427/305 |
| 4,196,061 | 1/1980 | Satee | 204/33 |

*Primary Examiner*—John D. Smith

*Attorney, Agent, or Firm*—Pennie & Edmonds

[57] ABSTRACT

A process for the electrolytic or electroless deposition of a coating of nickel on an aluminum or aluminum alloy substrate which comprises immersing the substrate in a hydroxide solution having a pH of about 12 or above, a nickel or cobalt compound soluble therein and a non-cyanide complexing agent for the nickel or cobalt compound capable of maintaining the nickel or cobalt metal in solution at a pH of about 12 or above, and electrolytically or electrolessly coating a layer of nickel thereon.

4 Claims, No Drawings

PROCESS FOR NICKEL PLATING ALUMINUM AND ALUMINUM ALLOYS

TECHNICAL FIELD

The invention relates to the direct nickel plating of aluminum and aluminum alloys.

BACKGROUND OF THE INVENTION

Aluminum and aluminum alloys are relatively soft materials and for many uses known in the art, it is desirable to upgrade or improve their wear and corrosion resistance. The conventional procedure for improving the wear and corrosion resistance of aluminum and its alloys is to coat the aluminum article with nickel. In order to obtain adequate adhesion of the nickel plate on the aluminum article, it is conventionally treated with an alkaline solution of sodium hydroxide containing sodium zincate and this process is usually referred to in the art as a "zincate dip". This process, however, leaves a zinc film on the aluminum article and, when plated with the nickel bath, the zinc dissolves in the nickel bath causing interference with the nickel plating and limiting the life of the nickel plating bath. In addition, the corrosion resistance (for example, salt spray) is not as good with the layer of zinc between the nickel plating and the aluminum article as it would be in the absence of the intermediate zinc layer. The high alkalinity of the zincate also tends to etch the aluminum article during the zincate dip pretreatment prior to nickel plating.

A number of attempts have been made to eliminate the shortcomings of the zincate dip, such as the use of nickel, cobalt and chromium cyanides in a solution of ammonium hydroxide as disclosed in the Satee U.S. Pat. No. 4,106,061 of April 1980. Other attempts to overcome the problems involved with the zincate process are disclosed in U.S. Pat. to Leloup, No. 3,284,323 of Nov. 8, 1966; Asada No. 3,515,650 of June 2, 1970; Bellis No. 3,672,964 of June 27, 1972; and Frasch No. 2,233,140 of Mar. 4, 1941. These patents show attempts to overcome the problems by modifying the zincate process, or, using poisonous cyanides or acid solutions to treat aluminum articles preparatory to zinc plating.

SUMMARY OF THE INVENTION

The present invention relates to a novel surface activating solution for the conditioning of aluminum and aluminum alloys preparatory to nickel plating and to a process for depositing nickel directly on aluminum or aluminum alloy articles utilizing a novel surface activating solution. The surface activating solution according to the invention is a non-zincate aqueous hydroxide solution having a pH of 12 or above containing a nickel or cobalt compound or salt soluble therein and a non-cyanide complexing agent for the nickel or cobalt compound capable of maintaining the solubility of the nickel or cobalt compound at a pH of about 12 or above.

THE INVENTION IN DETAIL

Any nickel or cobalt compound soluble in an alkaline solution containing complexing or chelating agents can be used according to the invention. The compounds can be inorganic, such as nickel or cobalt sulfate and chloride, or organic, such as nickel and cobalt acetate or tartrate. The requirement is that the compound must be capable of being solubilized in the solution.

The nickel or cobalt can vary in concentration and the amount of metal in solution should be sufficient to activate the aluminum surface for nickel plating with adequate adhesion. Although no lower or upper limits of the metal concentration have been determined, it has been found that anywhere between about 2 and 20 g/l is satisfactory as long as the quantity is sufficient to insure complete activation of the aluminum part. When the metal concentration is low, immersion times may range from 5 to 15 minutes but with concentrations as high as about 20 g/l, the immersion time may be around 30 seconds.

The high alkalinity of the activating solutions can be supplied by various compounds. Sodium and potassium hydroxide are particularly advantageous. The amount of hydroxide will depend to some degree on the substrate to be treated for subsequent nickel plating. Some alloys will require a higher hydroxide (pH) content than others. The hydroxyl content should be sufficient to cause a slight attack on the aluminum or aluminum alloy. When the aluminum substrate is immersed in the solution, and gassing takes place, this gassing shows that the hydroxide content is sufficient and that the solution is working properly. In terms of specific amounts, the hydroxide content expressed as sodium or potassium hydroxide will range from between about ½ and 15 g/l depending on the substrate being treated. The lower amounts of hydroxide may require a slightly longer immersion time while with higher amounts a very rapid immersion time may be necessary to prevent damage to the aluminum based substrate. Too long an immersion time adversely affects the adhesion of the subsequent nickel plating.

The immersion time is also a function of the metal content as discussed above as well as the particular aluminum substrate being treated. When the aluminum or aluminum alloy has a light greyish film on it, it is generally considered to be ready for nickel deposits. The optimum immersion time can readily be determined for any particular alloy or solution by routine experimentation.

The complexing agents can be any non-cyanide compound capable of complexing or chelating the nickel or cobalt salts and capable of keeping the metals in solution under the high alkalinity. Examples of such complexing agents include amines, such as diethylene triamine and ethylene diamine, nitrilo carboxylic acids, such as EDTA, phosphonic acid chelating agents, such as hydroxyethylidine phosphonate. The classes of complexing agents, such as those enumerated above, are well known, and the selection of the particular complexing and/or chelating agent, can be very broad so long as it is capable of keeping the metal salt in solution at high alkalinity. The selection will be dictated more by economical and ecological considerations since many different complexing chelating agents can be used. Combinations of complexing agents can also be used. The term "complexing agent" is used herein as generic to chelating agent.

The use of ammonium hydroxide in addition to the complexing agent and sodium or potassium hydroxide is also advantageous. Although the ammonium hydroxide will act as a complexing agent by itself it is not useful by itself at the high pH of the invention since the metal will precipitate. The ammonia ion, however, does aid, in combination with the complexing agents, in maintaining the metals in solution.

The amount of the complexing agent is not critical and should be used in sufficient amounts to complex nickel or cobalt and to keep the metals in solution under the highly alkaline conditions according to this invention. Thus, the amount will depend somewhat upon the particular complexing agent employed and its complexing strength. The amount of complexing agent also naturally depends on the amount of nickel or cobalt present. When utilizing nickel or cobalt at about 5–15 g/l, satisfactory amounts of the complexing agent would be between about 20 to 40 g/l or 20 to 40 ml/l. It is advantageous to use a slight excess of the complexing agent to insure that the metal remains in solution at the high alkalinity.

Once the amount of metal is selected and the amount of complexing agent selected which is sufficient to keep the metal in solution at high alkalinity, the alkalinity can be adjusted to a pH of about 12 or more by the addition of an hydroxide, preferrably sodium hydroxide, and/or ammonium hydroxide.

The aluminum alloys which can be treated according to the invention are those which contain about 75% and more aluminum. Commercially these aluminum alloys contain small amounts of other metals, such as magnesium, copper, zinc, selenium, etc. The aluminum articles themselves can be extruded, machined, or cast.

Although it is preferable to add the metal salt last, the order of mixing is not critical and the solutions are perfectly clear. If the solution is murky or contains solid particles it can be clarified by filtration.

The operating temperature of the activating solutions for practical reasons is preferably at ambient temperature. At ambient temperatures the immersion time is usually about two minutes although the process can be speeded up, as referred to above, by using higher nickel concentration, higher hydroxide concentrations or higher temperatures.

After the aluminum or aluminum alloy articles have been activated in accordance with the invention, they can be plated by conventionally known means, preferably by electroless nickel plating baths. After the plating operation has been completed, it is advantageous to bake the nickel plated articles at a temperature of about 500° F. for about ½ to one hour, since the high temperature bake is standard practice in the industry to assist in promoting adhesion of the deposits on aluminum.

The following examples illustrate the invention:

EXAMPLE 1 nickel acetate—15 g/l
diethylene triamine—30 ml/l
ammonium hydroxide—20 ml/l
sodium hydroxide—8 g/l
temperature—ambient
immersion time—2–4 minutes

EXAMPLE 2 nickel sulfate—25 g/l
ethylene diamine—40 ml/l
ammonium hydroxide—25 ml/l
potassium hydroxide—10 g/l
temperature—ambient
immersion time—1–4 minutes

EXAMPLE 3 nickel chloride—25 g/l
diethylene triamine—45 ml/l
sodium hydroxide—2 g/l
temperature—ambient
immersion time—3 minutes

EXAMPLE 4 nickel acetate—15 g/l
tetrasodium EDTA—25 g/l
sodium hydroxide—8 g/l
temperature—ambient
immersion time—2 minutes

EXAMPLE 5 nickel acetate—15 g/l
hydroxyethylidine phosphonate sodium salt—30 g/l
sodium hydroxide—9 g/l
temperature—ambient
immersion time—3 minutes The substrates treated with the solutions of Examples 1 to 5 included aluminum alloys 6061, 5052, 2024 and pure aluminum wire.

Before utilizing the solutions for activating the aluminum articles, the solutions wre filtered to obtain clear solutions.

All of the aluminum articles dipped into the activating solutions of the Examples were first cleaned in the conventional manner that is used for cleaning the aluminum articles when the conventional sodium zincate process is used for activating the aluminum articles. In essence the above activating solutions were merely used in place of the conventional sodium zincate solutions.

After treatment by the solutions, the parts were plated with conventional electroless nickel plating solutions and then baked at 500° F. for one hour. The resulting parts were easily plated with electroless nickel and the adhesion was good. The parts are, in all respects, at least equal to those obtained utilizing the conventional sodium zincate process.

Although no ammonium hydroxide was used in Examples 3 through 5, experience has shown that the presence of some ammonium ion is generally beneficial for the system.

We claim:

1. A process for treating aluminum and aluminum alloy substrates to improve the adhesion of subsequently applied electroless or electrolytic nickel deposits which comprises treating the substrate with a solution containing a soluble nickel or cobalt compound having a pH of about 12 or above and a non-cyanide complexing agent for the nickel or cobalt compound capable of maintaining the nickel or cobalt metal in solution at a pH of about 12 or above and which solution is further characterized by the absence of a reducing agent capable of reducing the nickel or cobalt compound to cause a buildup of nickel or cobalt metal on the substrate.

2. The process of claim 1 in which the pH of the solution is adjusted to about 12 with sodium or potassium hydroxide.

3. The process of claim 2 in which the complexing agent is a polyamine, a nitrilo carboxylic acid chelating agent, or a phosphonic acid chelating agent.

4. The process of claim 2 in which ammonia ion is added to the solution.

* * * * *

UNITED STATES PATENT AND TRADEMARK OFFICE

CERTIFICATE OF CORRECTION

PATENT NO. : 4,400,415

DATED : August 23, 1983

INVENTOR(S) : Richard B. Kessler and Fred I. Nobel

It is certified that error appears in the above—identified patent and that said Letters Patent is hereby corrected as shown below:

Column 1, line 40, reads "2,233,140" and should read --2,233,410--.

Signed and Sealed this

Tenth Day of April 1984

[SEAL]

*Attest:*

GERALD J. MOSSINGHOFF

*Attesting Officer*

*Commissioner of Patents and Trademarks*